United States Patent [19]

Cherry

[11] 3,949,341

[45] Apr. 6, 1976

[54] POWER VACUUM FUSE USING COAXIAL CYLINDERS

[75] Inventor: Sidney J. Cherry, Elmira, N.Y.

[73] Assignee: Westinghouse Electric Corporation, Pittsburgh, Pa.

[22] Filed: Feb. 3, 1975

[21] Appl. No.: 546,844

[52] U.S. Cl. ..... 337/161; 337/278

[51] Int. Cl.[2] ..... H01H 85/04

[58] Field of Search ..... 337/159, 161, 231, 251, 337/278, 293, 17, 18, 31, 32, 33, 34; 317/40 A

[56] References Cited

UNITED STATES PATENTS

| | | | |
|---|---|---|---|
| 3,244,839 | 4/1966 | Albright | 337/278 |
| 3,613,039 | 10/1971 | Curtis et al. | 337/161 |

*Primary Examiner*—J. D. Miller
*Assistant Examiner*—Fred E. Bell
*Attorney, Agent, or Firm*—W. G. Sutcliff

[57] ABSTRACT

A power vacuum fuse using coaxial electrodes with the fuse length disposed therebetween. In one embodiment of the invention a larger diameter outer cylinder is partially disposed around a hollow inner cylinder within an evacuated chamber and the fuse links are connected from the inner cylinder to the outer cylinder. The inner cylinder can have spiral or slots formed therein to move the arc as desired. In another embodiment of the invention a solid inner cylinder is disposed within a hollow diameter outer cylinder, which can form or be directly connected to a metallic enclosure. Current paths can be provided into the solid inner cylinder from both ends, thus substantially increasing the current carrying capacity of a given size vacuum fuse. In yet another embodiment of the invention a hollow inner cylinder is partially disposed within a larger diameter outer cylinder. The inner cylinder is connected at one end to a terminal means and the free end thereof has an outward radially extending lip which extends into a folded back hollow cylindrical portion from the inner diameter portion. Thus the hollow inner cylinder provides for an elongated current path in a direction to reduce some magnetic force.

13 Claims, 8 Drawing Figures

POWER VACUUM FUSE USING COAXIAL CYLINDERS

BACKGROUND OF THE INVENTION

1. Field of the Invention

This invention relates to protective devices for electrical circuits and more particularly to a power vacuum fuse having the fuse elements disposed in a vacuum.

2. Description of the Prior Art

In the usual vacuum type fuse an envelope or housing fabricated from a suitable insulated material such as glass, ceramic, or the like forms a vacuum chamber in which a pair of electrodes are disposed. A fuse link is connected between the electrodes of the vacuum fuse and a continuous current path is established through the fuse. During overload current operation current interruption is initiated by melting of the fuse link. When the fuse link melts an arc is formed across the arcing gap established between the electrodes. The arc vaporizes the link and a portion of the metallic electrode material; and, these particles become ionized to help sustain the arc through which current flows until natural current zero is reached. Some prior art vacuum fuses have been provided with a fusible link throughout the full length of the fuse connected to conductive members at each end of the fuse. Condensation shields are often provided around the fusible link to shield the inside of the insulating housing and to prevent the vaporized fuse link material and electrode material from depositing on the inside of the insulating housing and thus shorting out the fuse. The vaporized fuse link and electrode material sustains an arc until extinction at a current zero. After the current zero point has been reached recovery voltage transients begin building up between the electrodes. If the dielectric strength of the arcing gap, which is formed between electrodes when the fuse length melts, is sufficiently strong to withstand recovery voltage transients, breakdown will not occur, the arc will not reignite and circuit interruption will be complete. If the internal insulating surfaces of the vacuum fuse are not protected, the metallic vapors and particles formed during arcing can condense on the internal surfaces and form a metallic coating. In some instances this coating can form shorting paths and cause the vacuum fuse to fail to interrupt. To protect the insulating suffaces of the vacuum fuse it is customary to provide a metallic shield between insulating surfaces and the arc formed during interruption. Most of the metallic vapor then condenses on the shielding surfaces before reaching the insulating surfaces of the vacuum fuse protecting the insulating envelope or housing of the vacuum fuse, thus preventing a shorting of the vacuum fuse.

SUMMARY OF THE INVENTION

A vacuum type fuse comprising an evacuated housing, a first hollow cylinder disposed within the housing, a second cylinder at least partially disposed in the first cylinder, and a fusible link connecting the first and second cylinders. In one embodiment of the invention the vacuum interrupter housing is an insulating envelope generally tubular in shape with two metallic end caps mounted on opposite ends of the insulating envelope in sealing relationship. An outer hollow cylinder extends from one metallic end cap and an inner cylinder extends from the other end cap. A fuse link is connected between the outer and inner cylinder where there is coaxial overlap. The outer metallic cylinder acts as a shield to confine arc vapors and particles formed during circuit interruption, to the electrode and away from the inside surface of the insulating envelope. Pressure within the insulating envelope under steady state conditions is lower than $10^{-4}$ torr to assure that the mean free path for electron travel will be long with respect to the potential breakdown distance within the insulating envelope.

In one embodiment of the invention a larger diameter outer hollow cylinder extends from one end cap and a smaller diameter hollow cylinder extends from the other end cap, coaxial with the outer cylinder. The smaller diameter inner cylinder extends partially into the open end of the large diameter hollow outer cylinder. A fuse link is connected between the inner diameter cylinder and the outer diameter cylinder. In another embodiment of the invention, the inner cylinder has a spiral formed therethrough to control movement of the arc initiated after the fuse link melts. That is, the formed spiral moves the arc around and deeper into the larger diameter cylinder. In another embodiment of the invention the smaller diameter inner cylinder has a turned back portion formed at the free end thereof extending toward the end cap of the vacuum fuse to which the smaller diameter cylinder is attached. Thus the inner smaller diameter cylinder is in part formed from two coaxial hollow cylindrical portions connected at one end. This improves the current interrupting capability, since it substantially eliminates the magnetic field set up by the center electrode.

In another embodiment of the invention a hollow outer cylinder surrounds a solid inner cylinder and a fuse link is disposed between the inner and the outer cylinder. The outer cylinder can form a part of or be directly attached to the vacuum housing. The ends of the metallic housing to which the outer cylinder is connected are sealed by glass or ceramic insulating means. Conducting supports extend into the vacuum enclosure through the insulating sealing means to support the inner cylinder. A fuse link is connected between the inner and outer cylinders. The conducting supports for the inner cylinder can extend along the longitudinal axis of the outer cylinder and through both ends of the vacuum fuse thus providing a dual current pass into the vacuum fuse. This construction provides high current carrying capacity for a given vacuum fuse size.

It is an object of this invention to provide a vacuum fuse utilizing coaxial cylinders for the current carrying members with a fuse link disposed therebetween.

A further object of this invention is to provide a power vacuum fuse wherein coaxial cylinders are used for electrodes to shield the inner insulating surfaces of the vacuum housing from arc generated vapors and particles.

BRIEF DESCRIPTION OF THE DRAWINGS

For a better understanding of the invention, reference may be had to the preferred embodiment exemplary of the invention shown in the accompanying drawings, in which.

DESCRIPTION OF THE PREFERRED EMBODIMENTS

Figure 1:
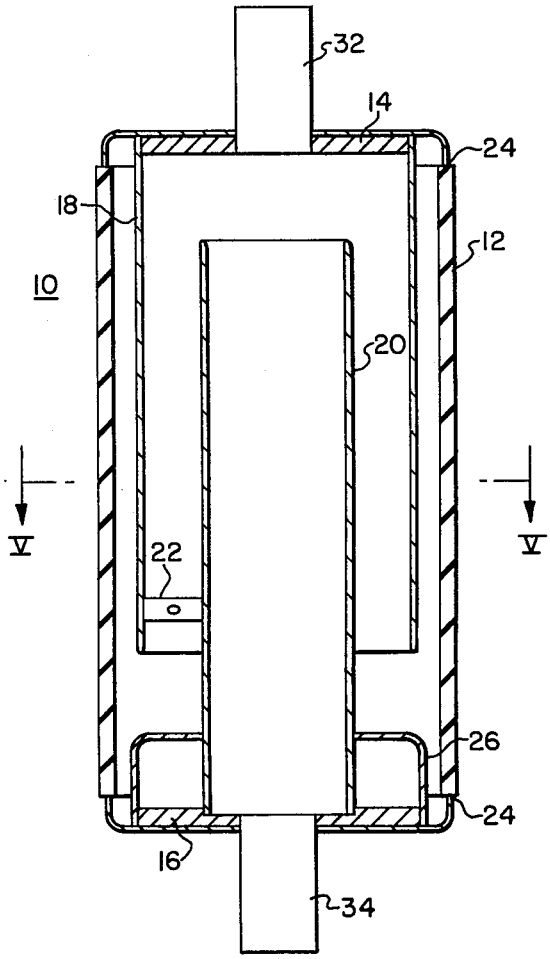
FIG. 1 is a side sectional view of a power vacuum fuse utilizing partially overlapping coaxial cylinders constructed according to the teaching of the present invention.
Figure 5:
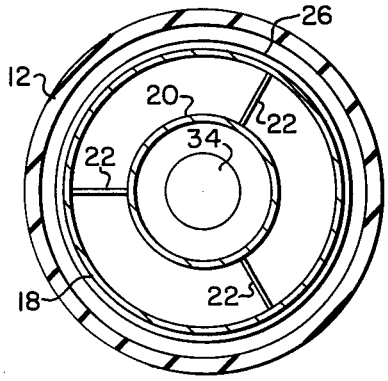
FIG. 5 is a view of the vacuum fuse shown in FIG. 1 along the lines V—V.

Refer now to the drawings and FIGS. 1 and 5 in particular there is shown a vacuum power fuse 10 utilizing the teaching of the present invention. The vacuum fuse 10 comprises a highly evacuated tubular insulating envelope 12 formed from glass or suitable ceramic material and a pair of metallic end caps 14 and 16 closing off the ends of the insulating envelope 12. Suitable seal means 24 are provided between the end caps 14 and 16 and the insulating envelope 12 to render the inside of the insulating envelope 12 vacuum tight. The pressure within the insulating envelope 12 under normal conditions is lower than $10^{-4}$ torr. Located within the insulating envelope 12 are a pair of fixed electrodes 18 and 20. A radially disposed fuse link 22 is connected between the inner cylindrical electrode 20 and the outer cylindrical electrode 18. When the fuse link 22 melts due to overload current flowing therethrough there is formed an arcing gap between electrodes 18 and 20. A conducting rod 32 is rigidly joined to end cap 14 by suitable means such as welding or brazing. A lower conducting rod 34 is suitably joined to end cap 16. Conducting rods 32 and 34 are utilized for making electrical connection to the vacuum fuse 10. The vacuum fuse 10 thus has a current path for from conducting rod 34 through end cap 16, cylinder 20, fuse link 22, cylinder 18, end cap 14, and conducting rod 32. When excessive overload current flows through this current path fuse link 22 is melted or vaporized and an arc is formed in the arcing gap area between electrodes 18 and 20. The arc which is formed between electrode 18 and 20 also vaporizes some of the electrode material. These vapors and particles from the fuse link 22 and the electrodes 18 and 20 are dispersed from the arcing gap towards the inner surface of the insulating envelope 12. The internal surfaces of the insulating envelope 12 are protected from the condensation of the arc generated metallic vapors and particles thereon by means of the tubular metallic electrode 18. Electrode 18 acts to intercept and condense arc generated metallic vapors and particles before they can reach the internal surface of insulating envelope 12. An end shield 26 is also provided to protect the sealing joint 24, between end caps 14 and 16 and the insulating envelope 12, from being bombarded by the arc generated metallic vapors and particles. End shield 26 also protects sealing joint 24 from high electrical stress. The speed with which the vapors generated during circuit interruption are removed determines the steady state operating conditions during arcing and also the interrupting capability of the vacuum fuse. If the vapors are not quickly removed, high voltage transients may cause the arc to reignite after it has been extinguished resulting in the failure of the vacuum fuse 10.

Figure 4:
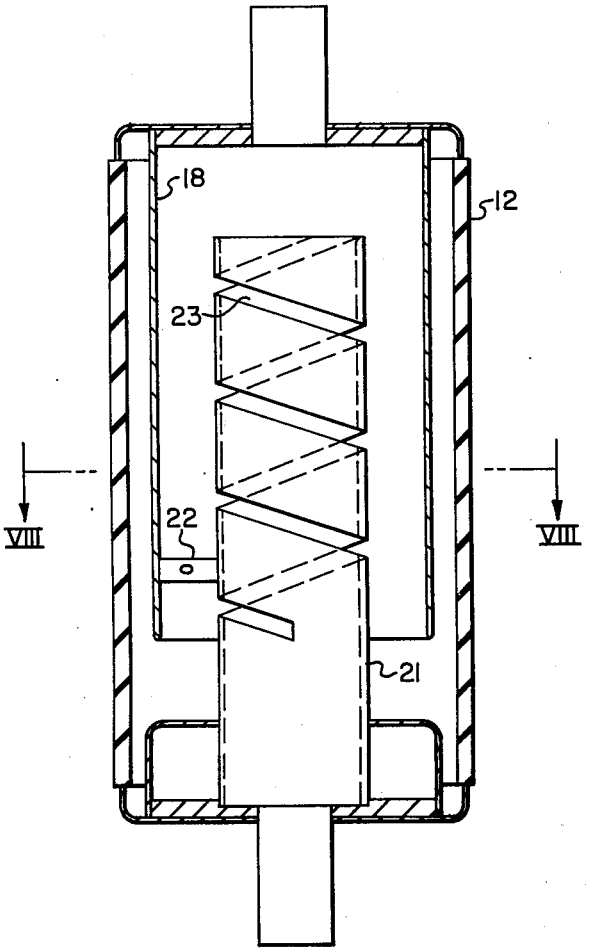
FIG. 4 is similar to FIG. 1 having a spiral formed in the inner cylindrical electrode to control arc movement.
Figure 8:
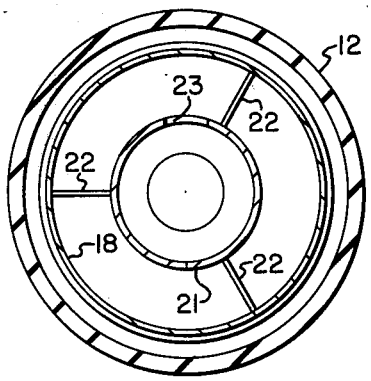

Referring now to FIGS. 4 and 8 there is shown another embodiment of the power vacuum fuse similar to that shown in FIG. 1 utilizing coaxial cylinders for electrodes. The inner hollow cylinder 21 as shown in FIG. 4 has a spiral 23 formed therein to provide a long pass for an anode spot if it developes. The spiral 23 formed in inner cylinder 21 moves the arc initiated during circuit interruption in a desired direction to facilitate containment and circuit interruption. The arc is formed when fuse link 22 between coaxial cylinder 21 and 18 melts due to an excessive overload current flowing therethrough.

Figure 3:
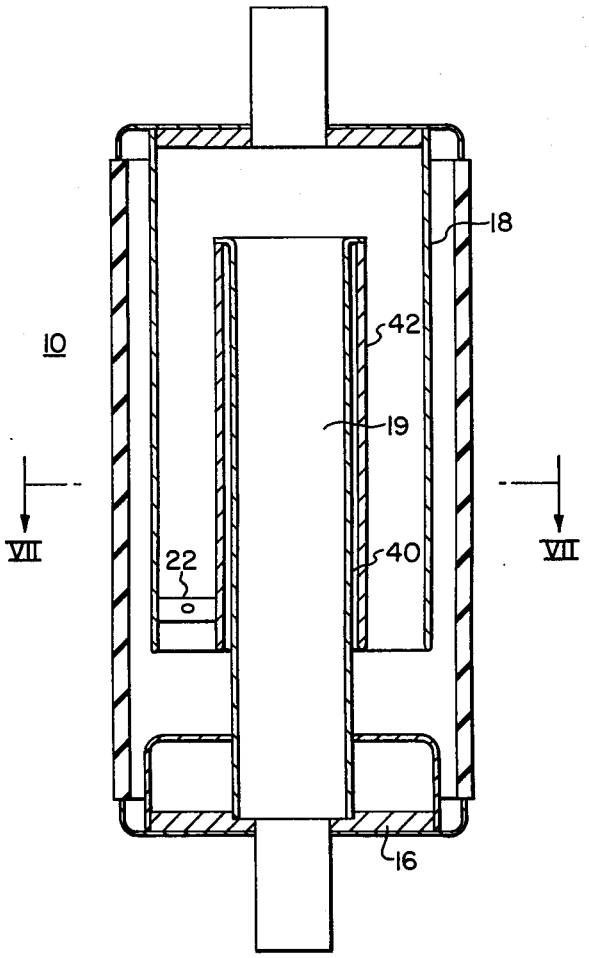
FIG. 3 is a view of a power vacuum fuse similar to FIG. 1 wherein the inner cylinder has a fold back cylindrical portion to improve interruption.
Figure 7:
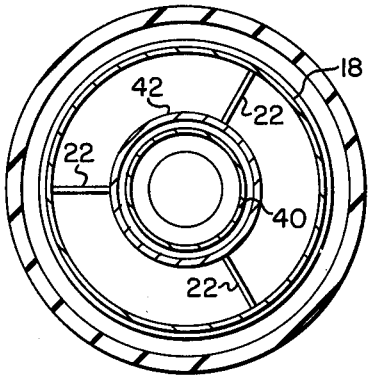
FIG. 7 is a sectional view of the vacuum interrupter shown in FIG. 3 along the line VII—VII; and, FIG. 8 is a view of the power vacuum fuse shown in FIG. 4 along the line VIII—VIII.

Referring now to FIGS. 3 and 7 there is shown a vacuum power fuse utilizing coaxial cylinders 18 and 19 which is similar to FIG. 1 but wherein the inner cylindrical electrode 19 has a fold back portion to improve interruption. Operation of the vacuum fuse is as described above. The inner electrode 19 has a first cylindrical portion 40 which extends from end cap 16 coaxially with the hollow cylinder electrode 18. The free end of electrode 19 folds back on itself to form a second cylindrical portion 42 coaxial with the inner cylindrical portion 40. This fold back design of the inner electrode 19 improves the current capability because it substantially eliminates the magnetic field set up by the center electrode 19. The fuse links 22 are disposed between the second cylindrical portion 42 of inner electrode 19 and the inner diameter of outer electrode 18. The number of fuse links utilized is dependent on desired current capability of the power vacuum fuse 10.

Figure 2:
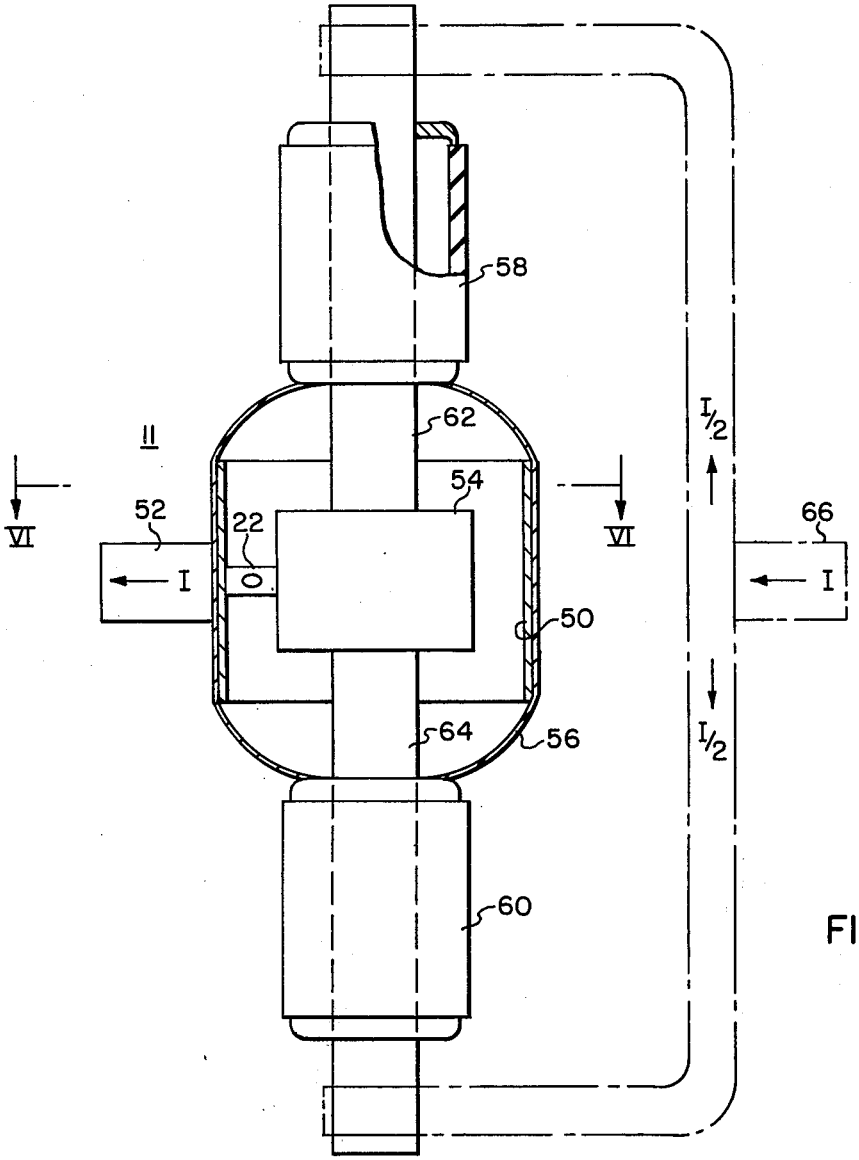
FIG. 2 is a side view partially in section of a vacuum fuse utilizing coaxial cylinders in accordance with the teaching of this invention wherein the outer cylinder is directly connected to the metal enclosure of the vacuum housing.
Figure 6:
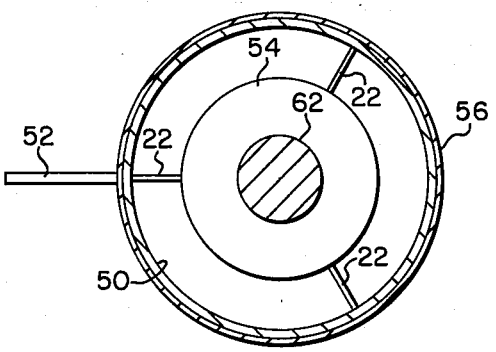
FIG. 6 is a view of the vacuum power fuse shown in FIG. 2 along the lines VI—VI.

Referring now to FIGS. 2 and 6 there is shown a power vacuum fuse 10 utilizing the teachings of the present invention. The power vacuum fuse 11 shown in FIG. 2 utilizes an outer hollow cylinder 50 for one electrode of the fuse link 22. A terminal 52 is connected to the outer electrode 50. Disposed within electrode 50 is a inner cylinder 54. A metallic envelope 56 surrounds the electrodes 50 and 54. Openings formed in metallic envelope 56 are sealed by suitable ceramic or glass insulating seals 58 and 60. Electrically conducting support rods 62 and 64 supports the inner cylindrical electrode 54 and extend through insulating sealing means 58 and 60 respectively. Conducting supports 62 and 64 provide current paths into the inner cylinder 54. Conducting rods 62 and 64 are connected to a terminal 66. Thus dual current paths into inner cylinder 54 are provided through support rods 62 and 64. This substantially increases the current capability for a given size vacuum housing. Thus a current path is established in power vacuum fuses 11 through conducting rods 62 and 64, inner cylinder 54, fuse link 22, outer conducting cylinder 50, and terminal 52. When excessive overload current flows through this current path fuse link 22 is melted, breaking the current path and the arc which is formed is extinguished at a current zero. When the fuse link 22 melts conducting rods 62 and 64 are electrically isolated from terminal 52 by the insulating sealing cylinders 58 and 60 and the vacuum within the vacuum enclosure 56.

The disclosed invention thus teaches the use of coaxial cylinders with a fuse element connected therebetween and utilizing a vacuum for insulation. The arc which developes when the fuse element 22 melts will be extinguished at a current zero. Because of the comparatively long length and area of the cylinderical coaxial electrodes the power vacuum fuse can be smaller than those utilized in the prior art for the same current ratings. The disclosed power vacuum fuse can for example be rated at 15 KV, 12 KA interrupting, and 300 amperes continuous or higher.

What is claimed is:

1. A vacuum fuse comprising:

a highly evacuated elongated insulating envelope;

a pair of end plates attached in sealing relationship to the ends of said highly evacuated insulating envelope rendering it vacuum tight;

a first hollow cylindrical electrode, electrically and mechanically connected to one of said end plates, extending longitudinally within said highly evacuated elongated insulating envelope;

a second electrode, electrically and mechanically connected to said end plate opposite the end plate to which said first electrode is connectedm extending longitudinally within said highly evacuated elongated insulating envelope and partially within said first hollow cylindrical electrode; and, a fuse link disposed generally radially with respect to said highly evacuated insulating envelope electrically connecting said first hollow cylindrical electrode and said second electrode.

2. A vacuum fuse as claimed in claim 1 wherein:

said second electrode comprises a hollow cylinder.

3. A vacuum fuse as caimed in claim 3 wherein: connected, said second hollow cylindrical electrode has a spiral form therein to move the arc formed during circuit interruption in a predetermined direction.

4. A vacuum fuse as claimed in claim 1 wherein:

said second electrode comprises:

a hollow cylindrical portion extending within said first hollow electrode;

a folded back cylindrical portion extending from the free end of said hollow cylindrical portion around said hollow cylindrical portion towards said end cap to which said second electrode is attached; and, said fuse element disposed between said folded back cylindrical portion and said first hollow cylindrical electrode.

5. A power vacuum fuse comprising:

an evacuated housing;

a hollow cylindrical electrode disposed within said evacuated housing;

a second electrode, spaced apart from said hollow cylindrical electrode, at least partially extending within said hollow cylindrical electrode;

first terminal means accessible from the outside of said evacuated housing and electrically connected to said hollow cylindrical electrode;

second terminal means accessible from outside of said evacuated housing and electrically connected to said second electrode; and, a fuse element disposed within said hollow cylindrical electrode, electrically connecting said hollow cylindrical electrode and said second electrode.

6. A power vacuum fuse as claimed in claim 5 wherein said evacuated envelope comprises:

a tubular insulating envelope;

a first end plate sealing one end of said tubular envelope; and, a second end plate sealing the other end of said tubular insulating envelope.

7. A power vacuum fuse as claimed in claim 6 wherein:

said hollow cylindrical electrode is electrically connected to and mechanically supported by said first end cap;

said second electrode is electrically connected to and mechanically supported by said second end cap; and, said second electrode comprises a first hollow cylindrical portion.

8. A power vacuum fuse as claimed in claim 7 wherein said hollow cylindrical electrode is slotted for moving any arc formed during circuit interruption in a known direction.

9. A power vacuum fuse as claimed in claim 7 wherein said second electrode comprises:

a second hollow cylindrical portion, surrounding a portion of said first hollow cylindrical portion, connected to the free end of said first hollow cylindrical portion and at least partially disposed within said hollow cylindrical electrode; and, said fuse elements disposed between said hollow cylindrical electrode and said second hollow cylindrical portion.

10. A power vacuum fuse comprising:

a tubular metallic housing which is highly evacuated;

first terminal means directly connected to the outside of said tubular metallic house;

a metallic cylinder disposed within and electrically insulated from said tubular metallic housing;

second terminal means external to said tubular metallic housing and electrically connected to said metallic cylindrical housing; and, a fuse link electrically connecting said tubular metallic housing and said metallic cylinder.

11. A vacuum fuse as claimed in claim 10 comprising:

first sealing means sealing one end of the tubular metallic housing; and, second sealing means sealing the other end of said tubular metallic housing.

12. A power vacuum fuse as claimed in claim 11 comprising:

first electrically conducting support means connected to and supporting said metallic cylinder and extending through said first sealing means; and, first insulating means insulating said first conducting support means from said first sealing means and being in a sealing relationship with said first conducting support means and said first sealing means;

second electrically conducting support means connected to and supporting said metallic cylinder and extending through said second sealing means;

second insulating means insulating said second electrically conducting support means from said second sealing means and being in a sealing relationship with said second conducting support means and said second sealing means rendering the inside of the power vacuum fuse vacuum tight.

13. A power vacuum fuse as claimed in claim 10 comprising:

connecting means connecting said first electrically conducting support means and said second electrically conducting support means; and, second terminal means electrically connected to said connecting means.

* * * * *